US008302968B2

(12) United States Patent
Mathews et al.

(10) Patent No.: US 8,302,968 B2
(45) Date of Patent: Nov. 6, 2012

(54) METHOD AND APPARATUS FOR PLAYING A GAME

(75) Inventors: Jane L. Mathews, Wildwood, MO (US); Roger K. Mathews, Wildwood, MO (US)

(73) Assignee: Jane's Games LLC, Wildwood, MO (US)

( * ) Notice: Subject to any disclaimer, the term of this patent is extended or adjusted under 35 U.S.C. 154(b) by 1577 days.

(21) Appl. No.: 11/139,889

(22) Filed: May 27, 2005

(65) Prior Publication Data

US 2006/0267277 A1 Nov. 30, 2006

(51) Int. Cl.
*A63F 3/00* (2006.01)

(52) U.S. Cl. ..... 273/242; 273/276

(58) Field of Classification Search ..... 273/242, 273/276

See application file for complete search history.

(56) References Cited

U.S. PATENT DOCUMENTS

| | | | | |
|---|---|---|---|---|
| 282,990 | A | 8/1883 | Johnson | |
| 3,649,018 | A | 3/1972 | Beam | |
| 3,672,681 | A | 6/1972 | Wolf | |
| 3,827,160 | A | 8/1974 | Talbot et al. | |
| 4,754,979 | A | 7/1988 | Vaseen | |
| 4,824,376 | A * | 4/1989 | Arash | 434/330 |
| 5,080,370 | A * | 1/1992 | Lu | 273/260 |
| 5,387,108 | A * | 2/1995 | Crowell | 434/319 |
| 6,022,026 | A | 2/2000 | Johnson, III | |
| 6,702,291 | B2 | 3/2004 | Grebler et al. | |
| 7,018,210 | B2 * | 3/2006 | Goldman et al. | 434/172 |

OTHER PUBLICATIONS http://www.funagain.com/control/product/~product_id+004199: Mar. 7, 2006 "Visionary" 2 pgs.

* cited by examiner

*Primary Examiner* — Vishu K. Mendiratta
(74) *Attorney, Agent, or Firm* — Thompson Coburn LLP; Clyde L. Smith

(57) ABSTRACT

A method of playing a multiplayer game comprises steps of providing a plurality of blocks and providing a plurality of viewable images. Each of the images represents a configuration of at least two of the plurality of blocks oriented in a particular manner with respect to each other. The method also comprises designating at least one game player of a first team to serve as an instructor of the first team. The instructor of the first team views the configuration of a first one of the images and then provides instructions regarding how to assemble the configuration shown in the first one of the images while at least one other of the game players of the first team attempts to construct at least part of the configuration out of the blocks using the instructions.

10 Claims, 5 Drawing Sheets

METHOD AND APPARATUS FOR PLAYING A GAME

BACKGROUND OF THE INVENTION (1) Field of the Invention

The present invention pertains to methods of playing multiplayer games and to game apparatus therefor. More particularly, the present invention pertains to a method of playing a multiplayer game wherein game players attempt to position a plurality of blocks into particular configurations.

(2) General Background

Games are often utilized as a source of entertainment during social gatherings. As such, various types of games have been developed to appeal to various interests of the general population. Such games range from being purely intellectual in character to being almost entirely physical. Additionally, some games involve quickness while others impose no time limitations.

In recent years, there has been a revitalization in the use of games for entertainment purposes. Over the past few decades, there has been an increasing tend to develop games that can rapidly achieve peak levels of excitement, that can be played or completed in relatively short periods of time, that can be played in teams, and that have relatively short learning curves. To achieve peak levels of excitement, games often include some aspect of competing against the clock or include competitive tasks where each team attempts to achieve or complete a task in less time than the other team or teams. Additionally, it is often desirable for games to be suited to a wide range of intellect and for such games to center around common skills and knowledge rather than around knowledge of unique or uncommon facts. Still further, it is often desirable for games to be playable by either a few people or many people, without the number of people playing the game adversely impacting the excitement of game play.

SUMMARY OF THE INVENTION

The apparatus and methods for playing a game in accordance with the present invention have many of the foregoing desirable traits. In general, the game of the present invention centers around players positioning blocks in particular configurations in response to instructions provided by teammates.

In one aspect of the invention, a method of playing a game comprises steps of providing a plurality of blocks and providing a plurality of viewable images. Each of the images is representative of a configuration of at least two of the plurality of blocks oriented in a particular manner with respect to each other. The method also comprises steps of providing a plurality of game players and dividing the game players into at least first and second teams, with each of the teams comprising at least two of the game players. Furthermore, the method comprises steps of designating at least one of the game players of the first team to serve as an instructor of the first team for at least a first round of game play, and having the instructor of the first team view the configuration of a first one of the images. Still further, the method comprises a step of having the instructor of the first team provide instructions regarding how to assemble the configuration of the first one of the images while at least one other of the game players of the first team attempts to construct at least part of the configuration of the first one of the images out of the blocks using the instructions.

In another aspect of the invention, an apparatus for use in playing a game comprises a plurality of blocks, a plurality of viewable images, and a medium having game play directions thereon. Each of the images is representative of a configuration of at least two of the plurality of blocks being in a particular orientation with respect to each other. The game play directions on the medium comprise steps of forming at least first and second teams with each of the teams comprising a plurality of game players, and selecting a first game player from among the plurality of game players of the first team. The game play directions also comprise steps of having the first game player view the configuration of a first one of the images, and having the first game player provide instructions regarding how to assemble the configuration of the first one of the images while at least one other of the game players of the first team attempts to construct at least part of the configuration of the first one of the images out of the blocks using the instructions.

While the principal advantages and features of the invention have been described above, a more complete and thorough understanding of the invention may be obtained by referring to the drawings and the detailed description of the preferred embodiments, which follow.

Figure 1:
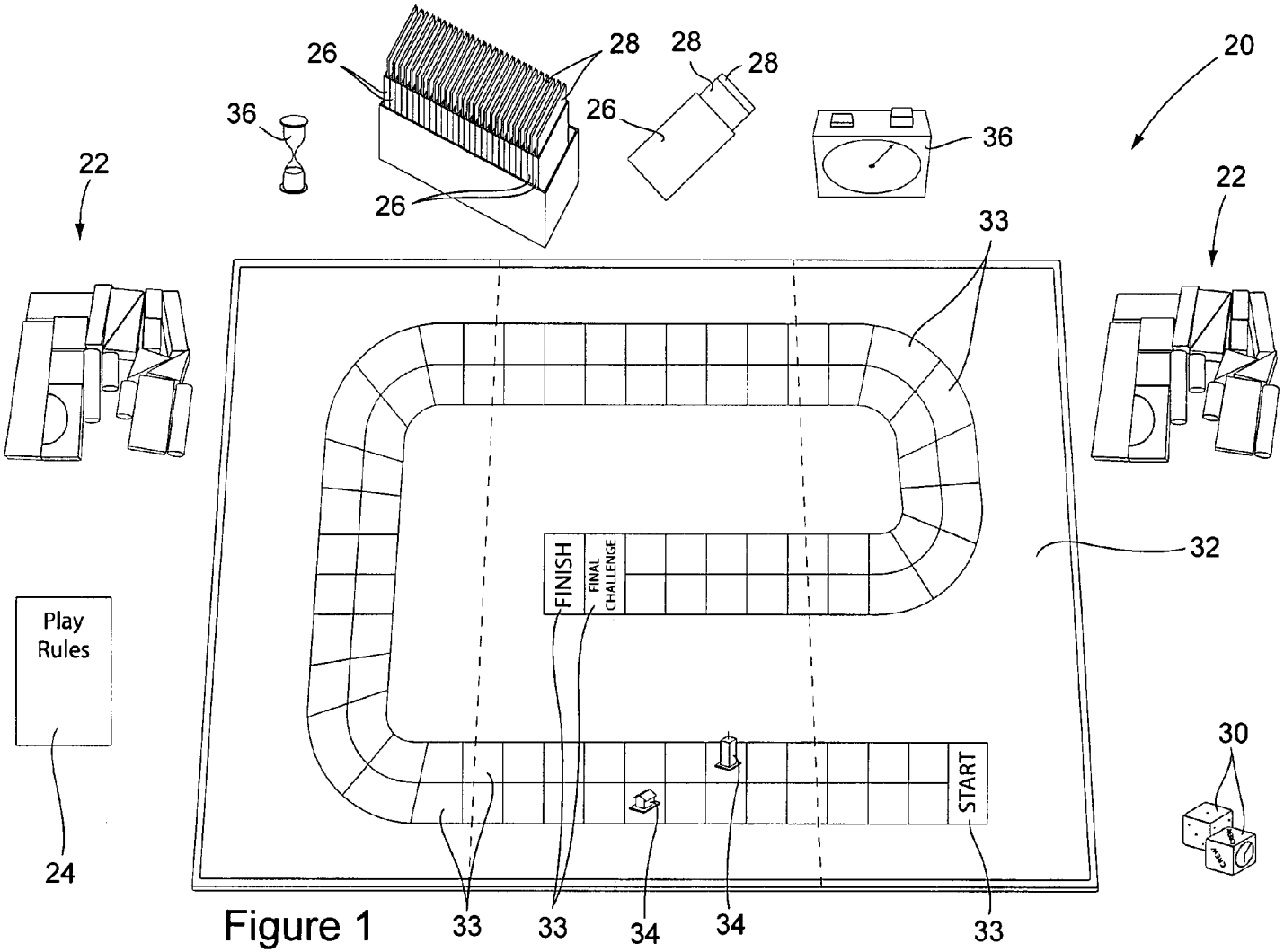
FIG. 1 is perspective view of an apparatus in accordance with the present invention for use in playing a game.

Reference characters in the written specification indicate corresponding items shown throughout the drawing figures.

DETAILED DESCRIPTION OF THE PREFERRED EMBODIMENTS OF THE INVENTION

An apparatus for playing a game in accordance with the invention is depicted in FIG. 1. The apparatus 20 preferably comprises a plurality of blocks 22, game playing rules 24, a plurality of packets 26 of playing cards 28, dice 30, a game board 32, tokens 34, and one or more timer devices 36.

The blocks 22 of the apparatus 20 preferably include various shapes and sizes of individual blocks. For example, the blocks 22 preferably include cylindrical, triangular, rectangular, square, and arched blocks. Additionally, the blocks 22 are preferably made of wood. However, the blocks 22 may alternatively be made from any suitable material such as metal, plastic, glass, or stone. Notably, the apparatus 20 preferably comprises at least two sets of the blocks 22. Preferably, the sets of blocks 22 each comprise the same number of blocks and have the same shapes of such blocks. Additionally, each set of blocks 22 is preferably visibly distinguishable from the other set or sets of blocks. For example, the blocks 22 of one set may have a different color or shade compared to the blocks of another set of blocks. This facilitates the task of sorting the blocks 22 into sperate sets when blocks become mixed together. Finally, the number of blocks 22 in each set is preferably sufficiently small to allow any particular block to be quickly located from among the other blocks of the set.

The game playing rules 24 of the apparatus 20 preferably comprise textual game play directions printed on a sheet of paper or in a book. The game play directions of the game playing rules 24 preferably explain and describe one or more methods of using all or part of the apparatus 20 to play a game. Examples of particular methods of using all or part of the apparatus 20 to play a game are described in greater detail below.

Figure 4:
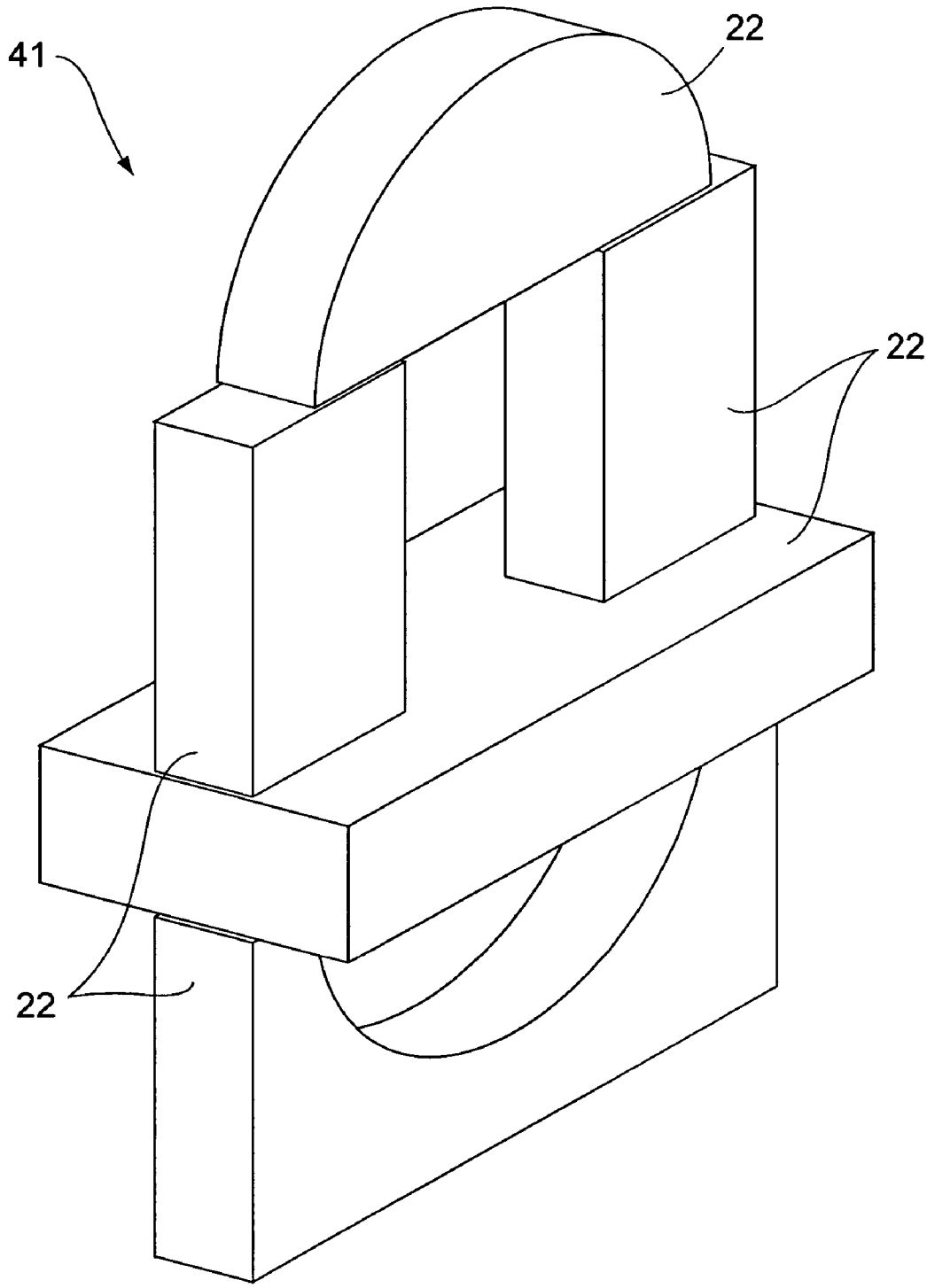
FIG. 4 is an example of a configuration of some of the blocks of the apparatus of FIG. 1 in a particular orientation with respect to each other.
Figure 5:
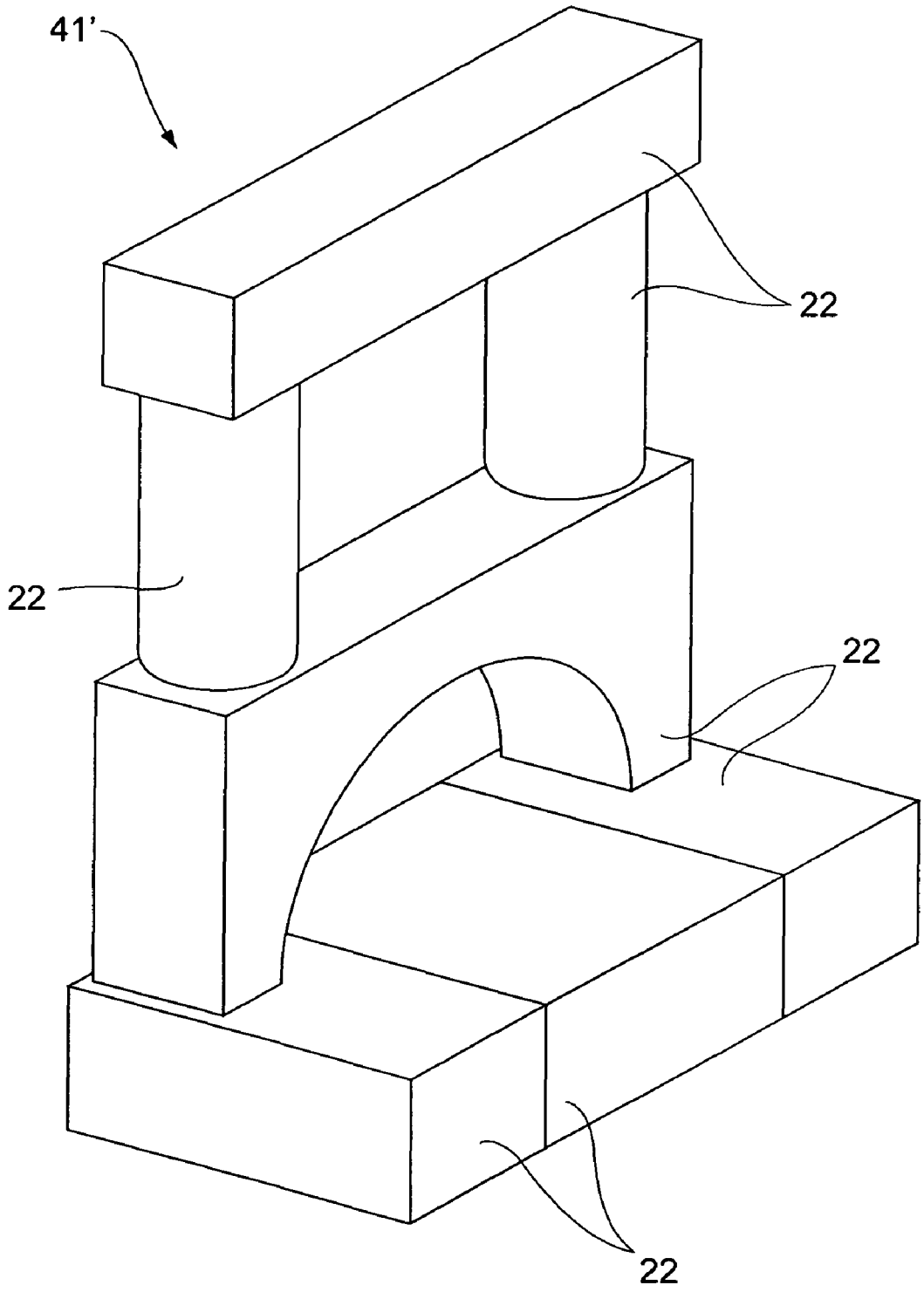
FIG. 5 is another example of another configuration of some of the blocks of the apparatus of FIG. 1 in a particular orientation with respect to each other.

The packets 26 of playing cards 28 of the apparatus 20 preferably comprise two playing cards per packet. Each packet 26 has a pocket 38, and the two playing cards 28 are configured to be removably placed within the pocket. Each playing card 28 is preferably formed from cardstock and preferably has an image 40 printed thereon. Additionally, each playing card 28 may have other indicia printed thereon, as explained below, for use during game play. Each image 40 is preferably a representation, such as photograph or drawing, depicting a particular configuration of at least two of the blocks 22 in a particular orientation with respect to each other. Preferably, the two playing cards 28 of each packet 26 have identical images 40 or images that depict the same configuration of the blocks 22. However, it should be appreciated that the images 40 and configurations shown on the playing cards 28 preferably vary from each packet 26 to the next. FIGS. 4 and 5 depict two different examples of different configurations 41,41' of some of the blocks 22.

Figure 3:
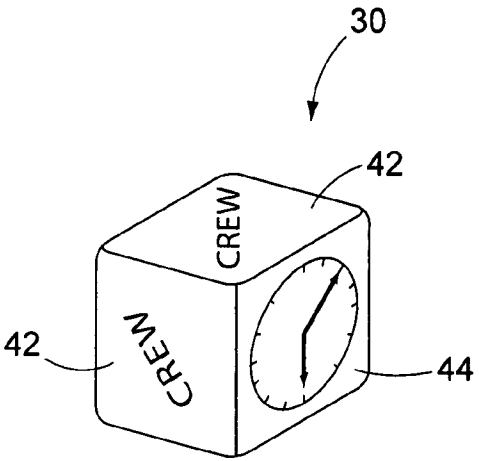
FIG. 3 is a die that is preferably a component of the apparatus shown in FIG. 1.
Figure 2:
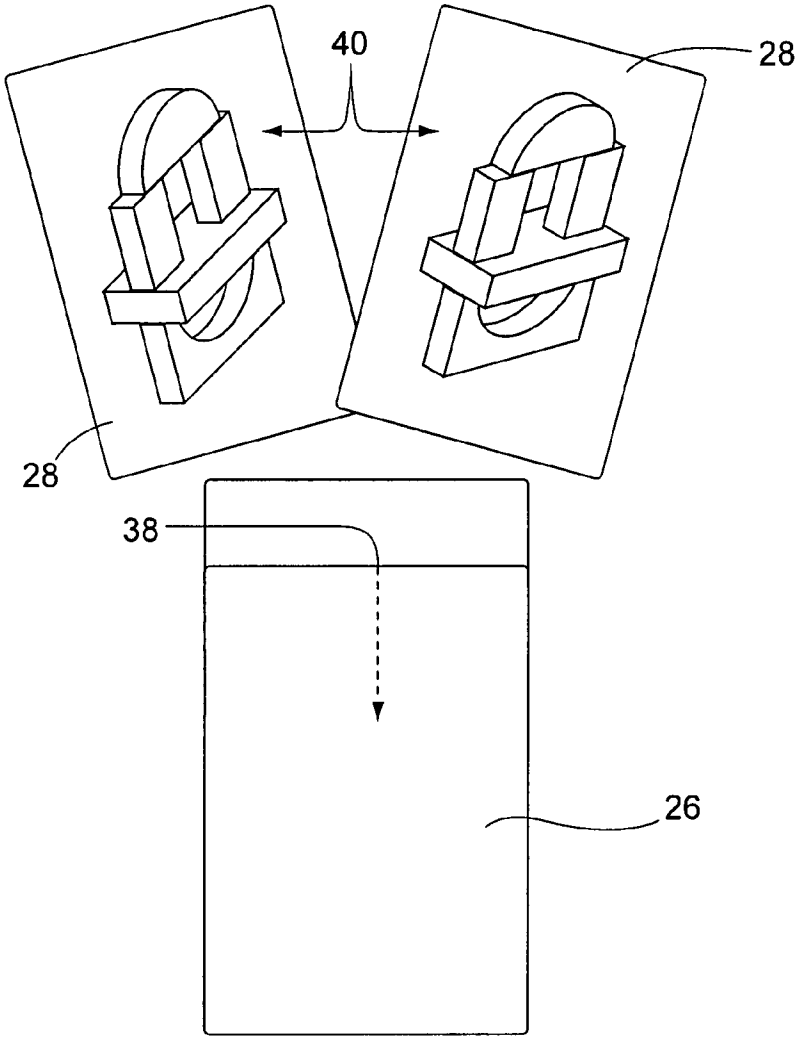
FIG. 2 is a packet of matching playing cards that preferably forms a component of the apparatus shown in FIG. 1.

The apparatus 20 preferably comprises two dice 30, at least one of which is preferably a specialized six-sided die as shown in FIG. 3. The specialized die 30 preferably comprises four faces 42 that bear matching indicia, and two other faces 44 that bear matching indicia. Preferably, the word "crew" appears on each of the four matching faces 42 of the die 30, and a representation of clock appears on each the other two faces 44. This specialized die is hereinafter referred to as the "challenge die." The other of the dice 30, although depicted as a standard six-sided die, is preferably a twelve-sided die and is hereafter referred to as the "advancement die." The advancement die is preferably a standard twelve-sided die of the type having the numbers one through twelve appearing on the separate faces of the die.

The game board 32 is preferably similar in shape and construction to a standard game board. Additionally, the game board 32 preferably comprises a plurality of reference spaces 33 arranged in two paths that comprise equal numbers of reference spaces. These reference spaces 33 serve as means to track the progression of a multi-round game as the game is played. Other reference spaces 33 preferably include a space identifiable as the starting space, a space identifiable as the "final crew challenge" space, and a space identifiable as the finish space. The game tokens 34, which are preferably standard game tokens similar to those commonly available, are utilized in connection with the reference spaces 33 of the game board 32 to track game play.

Like several of the above-mentioned components, the timer devices 36 of the apparatus 20 are preferably standard timer devices of the type often used in connection with games. For example, the timer device may be an hourglass, a windup timer, or an electronic timer. Preferably, the timer device 36 is configured to indicate the passage of both a first elapsed amount of time and a second elapsed amount of time. For example, the timer device may create an alarm noise after a set period of time has elapsed from the activation of the timer device, and thereafter may create another alarm noise after an additional fixed period of time has passed. Alternatively, the timer device 36 may comprise a pair of hourglasses that are affixed to each other and that measure different amounts of elapsed time.

Figure 6:
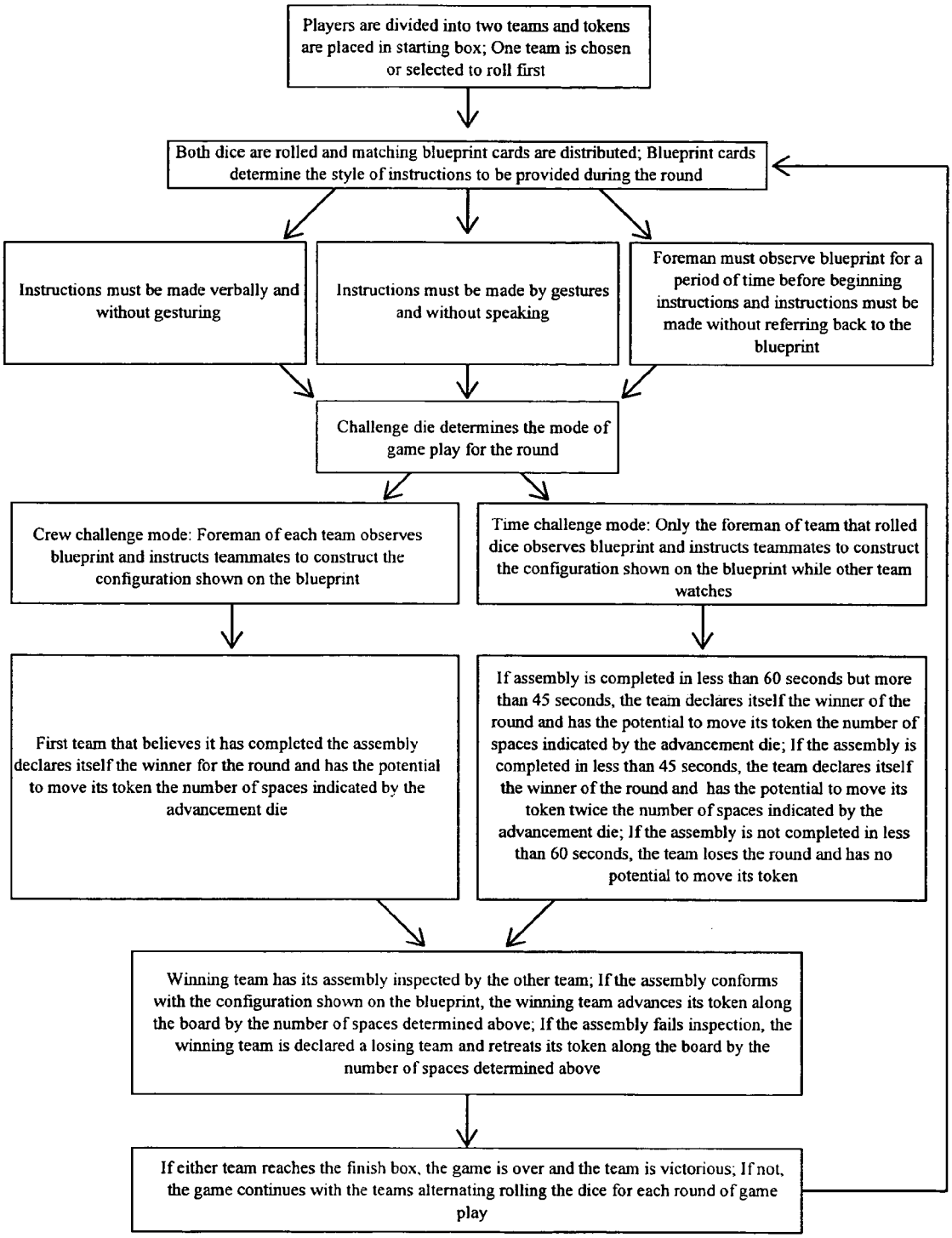
FIG. 6 is flow chart showing at least some of the steps of a method of playing a game in accordance with the invention.

Having described the above-mentioned components of the preferred apparatus for playing a game, methods of playing games using the apparatus are hereinafter discussed. FIG. 6 is a flow chart that generally shows some of the preferred steps and rules for playing a game in accordance with the invention. The preferred method of playing a game in accordance with the invention begins by initially dividing the game players into two teams of equal numbers of players or nearly equal number of players. A token for each team is chosen to represent the team and is placed on the starting reference space of the game board. Additionally each team is provided with a set of the blocks.

Game play preferably occurs in rounds, with one team rolling the dice for one round and the other team rolling the dice for the next round. One team is selected to go first and that team selects a "foreman" that will act as an instructor for his or her team for the particular round. The foreman preferably rolls both dice. The upward facing face of the challenge die determines the style of play for the particular round. As discussed above, this will be either one of the four matching faces of the die that display the word "crew" or one of the other two faces that display a representation of a clock. If the upward facing face of the challenge die is one of the four matching faces, the round will be played in a "crew challenge" mode. Alternatively, the round will be played in a "time challenge" mode.

In crew challenge mode, the foreman of the team that rolled the dice is provided a packet of playing cards and removes two playing cards therefrom. Additionally, the members of the other team select one of their teammates to serve as their foremen and one of the two playing cards is provided to that team member. The foremen then simultaneous commence viewing the images appearing on such cards and thereafter start providing instructions. The non-foreman team members of each team are preferably prohibited from viewing the image shown on the playing cards. Assuming that the playing cards are not specially marked as discussed below, the objective of the foreman of each team is to provide instructions to his or her other teammates that enable such teammates to assemble at least some of their blocks into the configuration of blocks depicted in the image of the particular playing cards. These instructions are preferably verbal instructions and the foreman is preferably prohibited from making gestures such as pointing or using other hand signals. Preferably, each of the teams compete against each other in a race to accurately assemble the configuration of blocks before the other team completes the same configuration. When a first team believes that it has accurately completed assembling the configuration, it notifies the other second team and further assembling ceases. The assembly constructed by the first team is then subject to a "building inspection" by the second team. If the second team determines that the constructed assembly fails to comply with the configuration shown in the image that appears on the playing cards, the second team can fail the constructed assembly. Alternatively, the second team can pass the constructed assembly.

If the constructed assembly passes the building inspection, the team that constructed it advances its token along the reference spaces of the game board by the number indicated on the upward facing face of the advancement die. Conversely, if the constructed assembly fails, the team that constructed it moves its token backwards along the reference spaces of the game board by the number indicated on the upward facing face of the advancement die. Thus, it should be appreciated that the building inspection aspect of the game acts to discourage teams from prematurely terminating a round merely to prevent the other team from completing the assembly of the configuration of blocks. It should also be appreciated that provisions can be provided to account for a team failing a building inspection prior to having advanced its token from the starting reference space. For example, such a team may advance its token with an understanding that, in following rounds, the team must move its token back along the reference spaces to the starting reference space prior to further advancement toward the finish reference space.

In the clock challenge mode of game play, the team that rolled the dice for the round plays against the clock rather than against the other team. Preferably, the timer device is utilized in this mode of game play. Upon activating the timer device, the foremen of the team that rolled the dice begins providing instructions to his or her teammates in the same manner as explained for the crew challenge mode. Preferably, the timer device is capable of indicating whether more than forty-five seconds has elapsed and whether more than sixty seconds has elapsed from when the timer device was activated. If the team fails to assemble the configuration of blocks within sixty seconds, the team loses the round and no advance of tokens occurs. If the team believes that it has successfully assembled the configuration of blocks and the elapsed time is between forty-five and sixty seconds, the assembled configuration of blocks is subjected to a building inspection by the other team and the team that constructed the assembly advances its token or moves its token backward in the same manner as described above in reference to the crew challenge mode. Similarly, if the team believes that it has successfully assembled the configuration of blocks and the elapsed time is under forty-five seconds, the assembled configuration of blocks is subjected to a building inspection by the other team and the team that constructed the assembly advances its token or moves its token backwards in the same manner as described above in reference to the crew challenge mode, except that the number of spaces moved is doubled.

As mentioned above, some of the packets of playing cards may contain specially marked playing cards that alter the method of game play. For example, the playing cards may indicate that the round is to be played in a "silent" mode or in a "memory" mode. In the silent mode, the round of game play is performed as a crew challenge or clock challenge round in the same manner as described above, with the exception that the instructions provided by the foreman or the foremen are nonverbal instructions and gesturing in this case is allowed. However, unlike the crew challenge mode described above, in memory mode, the foremen are given a set amount of time to review the configuration of the blocks that appears on the playing cards, prior to providing instructions to their respective teammates. In this mode, when the foremen commence providing instructions, the foremen must provide those instructions without referring back to the playing cards.

Yet another mode of game play may include a "rotating builders" mode. In this mode, the foreman provides instructions in the manner described above, except that only one of his or her teammates is permitted to assemble any portion of the configuration of blocks at any given time. When the foreman believes that the teammate has correctly positioned one of the blocks of the relevant configuration, another one of the foreman's teammates takes over the role of placing another block. Thus, the foreman's teammates take turns placing the blocks of assembly.

Still further, another mode of game play may include a "many foremen" mode. In this mode, a plurality of teammates act as a foremen during a round of game play. This mode may be played with the plurality of teammates working collectively and simultaneously as if they were a single foreman. Alternatively, this mode may be played in manner such that the foremen of a team take turns providing instructions during a round as blocks are placed by their teammates.

It should be appreciated that the teams alternate rolling the dice from one round to the next. Additionally, it should be appreciated that after several rounds of game play, at least one of the teams will have advanced its token to the reference space on the game board that is immediately next to the finish space. Preferably, that team can not advance it's token beyond that space until it prevails in a subsequent crew challenge mode round. Also preferably, the advancement die is immediately thereafter rolled and a crew challenge mode round is played. If the team next to the finish space loses that round, the other team preferably advances its token by the number shown on the advancement die. In such a case, the game would continue with the trailing team preferably rolling both die. If the challenge die indicates that a time challenge mode is to be played, the trailing team then plays a time challenge mode round as described above and, upon succeeding in that mode, may advance its token and either roll the die again or alternate rolling the die with the other team. However, at any time the die are rolled and indicate a crew challenge mode round is to be played, any team that is adjacent the finish space and that is victorious in such round is preferably declared the winner of the game.

In view of the foregoing, it should be appreciated that methods and apparatus of the present invention can provide a unique means of entertainment. Moreover, it should be appreciated that the methods for playing a game in accordance with the invention can be learned in a short period of time.

While the present invention has been described in reference to specific embodiments, in light of the foregoing, it should be understood that all matter contained in the above description or shown in the accompanying drawings is intended to be interpreted as illustrative and not in a limiting sense and that various modifications and variations of the invention may be constructed without departing from the scope of the invention defined by the following claims. For example, it should be appreciated that a game board is not necessary to practice the invention and that single round games could be played with merely the blocks and images. Additionally, other things such as the packets for the playing cards, the timer devices, and dice are not essential to the game. Thus, other possible variations and modifications should be appreciated.

Furthermore, it should be understood that when introducing elements of the present invention in the claims or in the above description of the preferred embodiment of the invention, the terms "comprising," "including," and "having" are intended to be open-ended and mean that there may be additional elements other than the listed elements. Similarly, the term "portion" should be construed as meaning some or all of the item or element that it qualifies.

Still further, it should be understood that when introducing elements of the present invention in the claims or in the above description of the preferred embodiments, the terms first and second are used merely as identifiers and do not impose any sort of time limitation into the claims or description.

What is claimed is:

1. An apparatus comprising:

a plurality of blocks a plurality of viewable images, each of the images being representative of a configuration of at least two of the plurality of blocks being in a particular orientation with respect to each other; and a medium comprising game play directions, the game play directions comprising steps of forming at least first and second teams with each of the teams comprising a plurality of game players, selecting a first game player from among the plurality of game players of the first team, having the first game player view the configuration of a first one of the images, and having the first game player provide instructions regarding how to assemble the configuration of the first one of the images while at least one other of the game players of the first team attempts to construct at least part of the configuration of the first one of the images out of the blocks using the instructions.

2. An apparatus in accordance with claim 1 wherein the game play directions of the medium comprise a step of having the first game player verbalize instructions, without gesticulating, regarding how to assemble the configuration of the first one of the images while at least one other of the game players of the first team attempts to construct the configuration of the first one of the images out of at least two of the blocks using the verbal instructions.

3. An apparatus in accordance with claim 1 wherein the game play directions of the medium comprise a step of having the first game player gesticulate instructions, without verbalizing, regarding how to assemble the configuration of the first one of the images while at least one other of the game players of the first team attempts to construct the configuration of the first one of the images out of at least two of the blocks using the gesticulated instructions.

4. An apparatus in accordance with claim 3 wherein the game play directions of the medium comprise a step of having the first game player verbalize instructions, without gesticulating, regarding how to assemble the configuration of the first one of the images while at least one other of the game players of the first team attempts to construct the configuration of the first one of the images out of at least two of the blocks using the verbal instructions.

5. An apparatus in accordance with claim 1 wherein the game play directions of the medium comprise steps of selecting a second game player from among the plurality of game players of the second team, and having the second game player provide instructions regarding how to assemble the configuration of the first one of the images while at least one other of the game players of the second team attempts to construct the configuration of the first one of the images out of at least two of the blocks using the instructions provided by the second game player concurrently with the step of having the first game player provide the instructions.

6. An apparatus in accordance with claim 1, wherein the game further comprises a game board, and wherein the game play directions of the medium comprise an exemplary description of how the game players can utilize the game board during game play.

7. An apparatus in accordance with claim 6 wherein the game further comprises a plurality of tokens and at least first and second dice, and wherein the game play directions of the medium comprise a step of using the first die to determine a style of game play to be used during a round of game play and a step of using the second die to control movement of at least one of the tokens relative to the game board.

8. An apparatus in accordance with claim 1 wherein the game play directions of the medium comprise a step of rewarding the first team for constructing one of the configurations of the images within a period of time.

9. An apparatus in accordance with claim 1 wherein the game play directions of the medium comprise a step of having the first game player provide instructions regarding how to assemble the configuration of the first one of the images while the at least one other of the game players of the first team attempts to construct the configuration of the first one of the images out of at least two of the blocks using the instructions and while the first player refrains from viewing the configuration of the first one of the images.

10. An apparatus in accordance with claim 1 wherein the medium is at least one piece of paper and the game play directions are provided in the form of text provided on the at least one piece of paper, and wherein the viewable images are provided on a plurality of playing cards.

* * * * *